US009024835B2

(12) United States Patent
Chen et al.

(10) Patent No.: US 9,024,835 B2
(45) Date of Patent: May 5, 2015

(54) INTEGRAL HIGH FREQUENCY COMMUNICATION APPARATUS

(75) Inventors: Ruei Yuen Chen, Hsinchu (TW); Hsiang Hao Sung, Hsinchu (TW)

(73) Assignee: Microelectronics Technology, Inc., Hsinchu (TW)

( * ) Notice: Subject to any disclaimer, the term of this patent is extended or adjusted under 35 U.S.C. 154(b) by 757 days.

(21) Appl. No.: 13/339,243

(22) Filed: Dec. 28, 2011

(65) Prior Publication Data

US 2012/0092092 A1 Apr. 19, 2012

Related U.S. Application Data

(63) Continuation-in-part of application No. 12/260,705, filed on Oct. 29, 2008, now Pat. No. 8,106,843.

(30) Foreign Application Priority Data

Dec. 25, 2007 (TW) ..... 96149885 A

(51) Int. Cl.

| | |
|---|---|
| ***H01Q 13/00*** | (2006.01) |
| ***H01Q 1/24*** | (2006.01) |
| ***H01Q 13/02*** | (2006.01) |
| ***H01Q 19/12*** | (2006.01) |
| ***H01Q 21/28*** | (2006.01) |

(52) U.S. Cl.

CPC ..... *H01Q 1/247* (2013.01); *H01Q 13/02* (2013.01); *H01Q 19/12* (2013.01); *H01Q 21/28* (2013.01)

(58) Field of Classification Search

CPC ..... H01Q 13/20; H01Q 13/06; H01Q 13/28

USPC ..... 343/772, 767, 762

See application file for complete search history.

(56) References Cited

U.S. PATENT DOCUMENTS

| | | | | |
|---|---|---|---|---|
| 6,710,685 | B1 * | 3/2004 | Sciarrino | 333/254 |
| 7,474,173 | B2 * | 1/2009 | Avramis et al. | 333/126 |
| 2003/0034930 | A1 * | 2/2003 | Chen | 343/786 |
| 2004/0203528 | A1 * | 10/2004 | Ammar et al. | 455/90.3 |
| 2010/0029199 | A1 | 2/2010 | Chen et al. | |
| 2010/0285758 | A1 | 11/2010 | Laidig et al. | |

FOREIGN PATENT DOCUMENTS

WO 2008123836 10/2008

OTHER PUBLICATIONS

Search report dated Apr. 2, 2013 from EP counterpart application 11196062.1.

* cited by examiner

*Primary Examiner* — Dameon E Levi
*Assistant Examiner* — Collin Dawkins
(74) *Attorney, Agent, or Firm* — WPAT, P.C.; Anthony King; Kay Yang

(57) ABSTRACT

An integral high frequency communication apparatus comprises a case, a waveguide apparatus having an extension portion, and a circuit board having a signal transmitting unit and a signal receiving unit. The transceiver module having two waveguide openings is retained in the case. The case has an opening through which the extension portion extends outside of the case. The integral high frequency communication apparatus can receive and transmit high frequency signals by the extension portion.

6 Claims, 4 Drawing Sheets

INTEGRAL HIGH FREQUENCY COMMUNICATION APPARATUS

This present application is a continuation-in-part application of U.S. patent application Ser. No. 12/260,705, filed on Oct. 29, 2008.

BACKGROUND OF THE INVENTION (A) Field of the Invention

The present invention relates to an integral high frequency communication apparatus, and more particularly, to a high frequency communication apparatus integrated with a waveguide.

(B) Description of the Related Art

Microwave transmitting signals between a receiver on the ground and a satellite cannot easily penetrate walls, roofs or even glass windows of a building. Therefore, nearly all satellite signal transceivers are placed outdoors, with their antennas are aimed toward the satellite for optimal transmission efficiency. Because the satellite signal transceivers need to be placed outdoors, the satellite signal transceivers have to maintain normal operation under different weather conditions. In particular, such apparatuses with an integrated circuit have a serious need to withstand harsh environmental conditions.

FIG. 1 is a schematic diagram of a traditional high frequency communication apparatus for outdoor use. A high frequency communication apparatus 10 comprises a waveguide 11 and a case 12. The waveguide 11 is combined with the surface of the case 12 by fastening devices, and is not covered by the case 12. The waveguide 11 comprises a first separated block 111 and a second separated block 112 that are combined with each other for sealing, also by fastening devices. An extension portion 113 is combined with the first separated block 111 and second separated block 112 along the side opposite the case 12. A flange 114 is provided on the end of the extension portion 113 for combination with a satellite antenna.

Even if the first separated block 111 and second separated block 112 are combined with each other, the two blocks 111 and 112 are still exposed to the atmosphere. Dust and moisture are likely to penetrate the interior of the waveguide channel through the interface of the two blocks 111 and 112. Similarly, a flaw is likely to exist in the interface of the waveguide 11 and case 12. The size of the flaw could be changed by the aging, expansion or contraction of the material. Moreover, the waveguide 11 is erected on the case 12, so the volume of the entire apparatus 10 is large. Accordingly, the system, including the apparatus 10, is affected.

In view of the above, the conventional high frequency communication apparatus 10 for outdoor application has several disadvantages. The high frequency communication market urgently needs a high frequency communication apparatus that has a small volume and is not susceptible to environmental influences. Such a development will resolve the aforesaid problems.

SUMMARY OF THE INVENTION

The present invention provides an integral high frequency communication apparatus. A waveguide apparatus is integrated into a case so that the portion of the waveguide apparatus exposed to the environment is minimized. Therefore, not only is the volume of the entire apparatus reduced, but also the ability to withstand environmental influences is improved. Thus, the quality of the high-frequency communication is more stable.

The present invention discloses an integral high frequency communication apparatus comprising a case, a waveguide apparatus having an extension portion, and a circuit board accommodated in the case and including a signal transmitting unit and a signal receiving unit.

The present invention also discloses an integral high frequency communication apparatus comprising a case, a waveguide apparatus having an extension portion, a circuit board accommodated in the case and including a signal transmitting unit and a signal receiving unit, and a spacing module having a first waveguide opening and a second waveguide opening The waveguide apparatus, the spacing module, and the circuit board are accommodated in the case. The spacing module is disposed between the waveguide apparatus and the circuit board. The case has an opening through which the extension portion extends outside of the case. The integral high frequency communication apparatus can receive and transmit high frequency signals through the extension portion.

In another embodiment, a plurality of combination flanges are provided on one end of the extension portion, and surround the extension channel of the extension portion. At least one positioning plane is disposed on a side of one of the plurality of combination flanges facing the extension channel. The positioning plane is to facilitate the swift positioning and combination of an extensible component.

BRIEF DESCRIPTION OF THE DRAWINGS

The objectives and advantages of the present invention will become apparent upon reading the following description and upon reference to the accompanying drawings in which.

DETAILED DESCRIPTION OF THE INVENTION

The following descriptions illustrate an integral high frequency communication apparatus of the present invention. Regarding the schematic diagrams disclosed by embodiments, the present invention is only illustrated by diagrams, but the scope of the present invention is not limited by the diagrams. These schematic diagrams show the structure of the apparatus, while the dimensions of the diagrams cannot limit the scope of the present invention. The aforesaid statements are intended to provide further understanding before the following embodiments are introduced.

Figure 2:
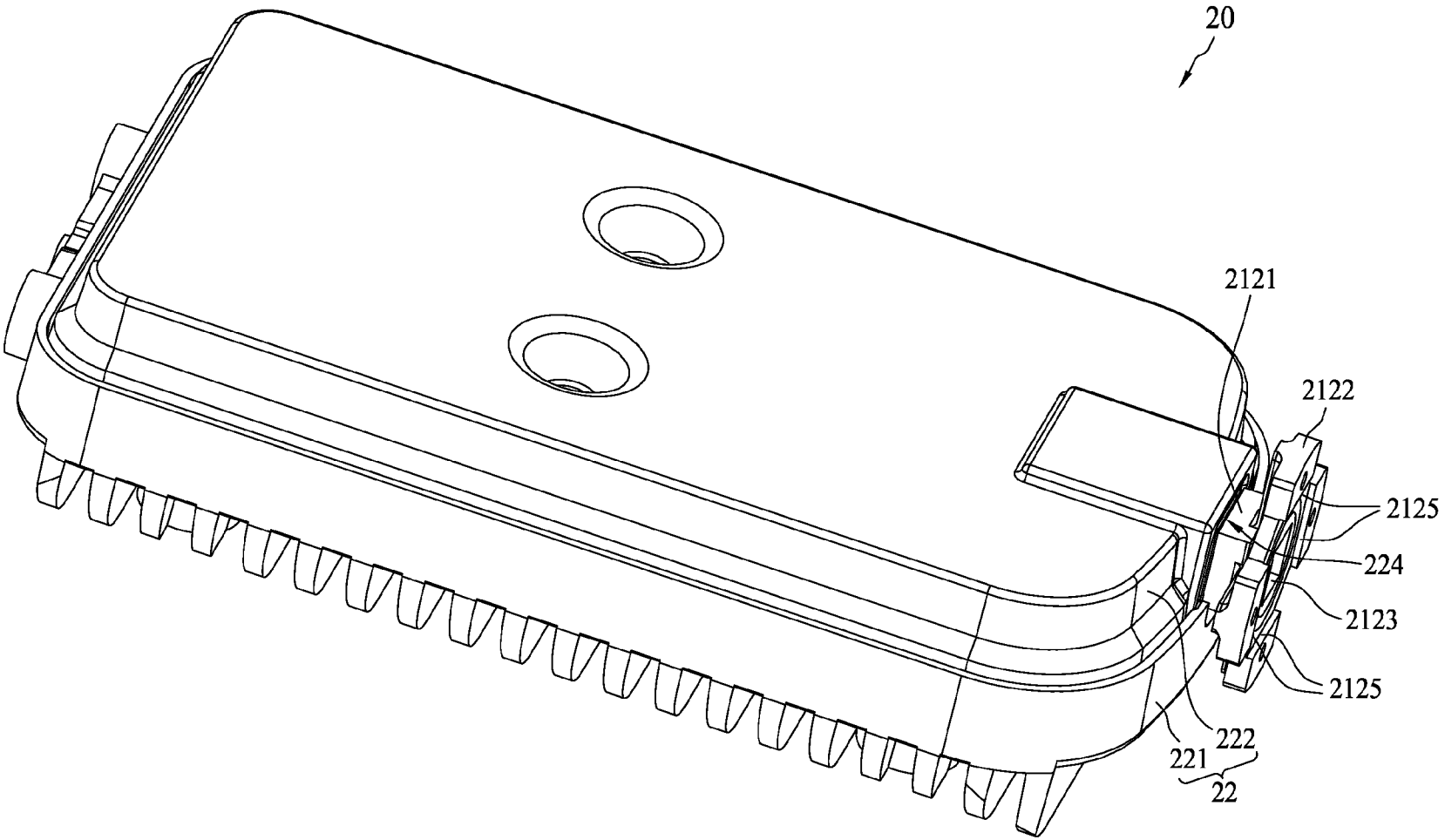
FIG. 2 is a perspective diagram of an integral high frequency communication apparatus in accordance with an embodiment of the present invention.

FIG. 2 is a perspective diagram of an integral high frequency communication apparatus in accordance with an embodiment of the present invention. Most parts of the integral high frequency communication apparatus 20 of the present embodiment are sealed in the case 22, but an extension portion 2121 of the waveguide apparatus 21 is outside the case 22. The gap in the junction of the waveguide apparatus 21 is isolated from the atmosphere. Such an integral design can completely protect the entire communication apparatus whose communication channels include Ku band, C band or Ka band. The waveguide apparatus 21 is placed in the case 22 including a body 221 and a cover 222. In addition to the junction of the body 221 and the cover 222, there are junctions between the extension portion 2121 and an opening 224 of the case 22 through which the extension portion 2121 extends. Adhesive can be applied to the junctions or O-rings can be interposed in the junctions. The interior of the case 22 is thereby isolated from the exterior so that moisture and dust cannot penetrate into the interior. Such a sealing result meets the standard IP68.

A plurality of combination flanges 2122 are provided on another end of the extension portion 2121, and surround the extension channel 2123 of the extension portion 2121. A positioning plane 2125 is disposed on a side of the combination flange 2122 facing the extension channel 2123. The positioning plane 2125 is for an extensible component to be swiftly positioned and combined.

Figure 3:
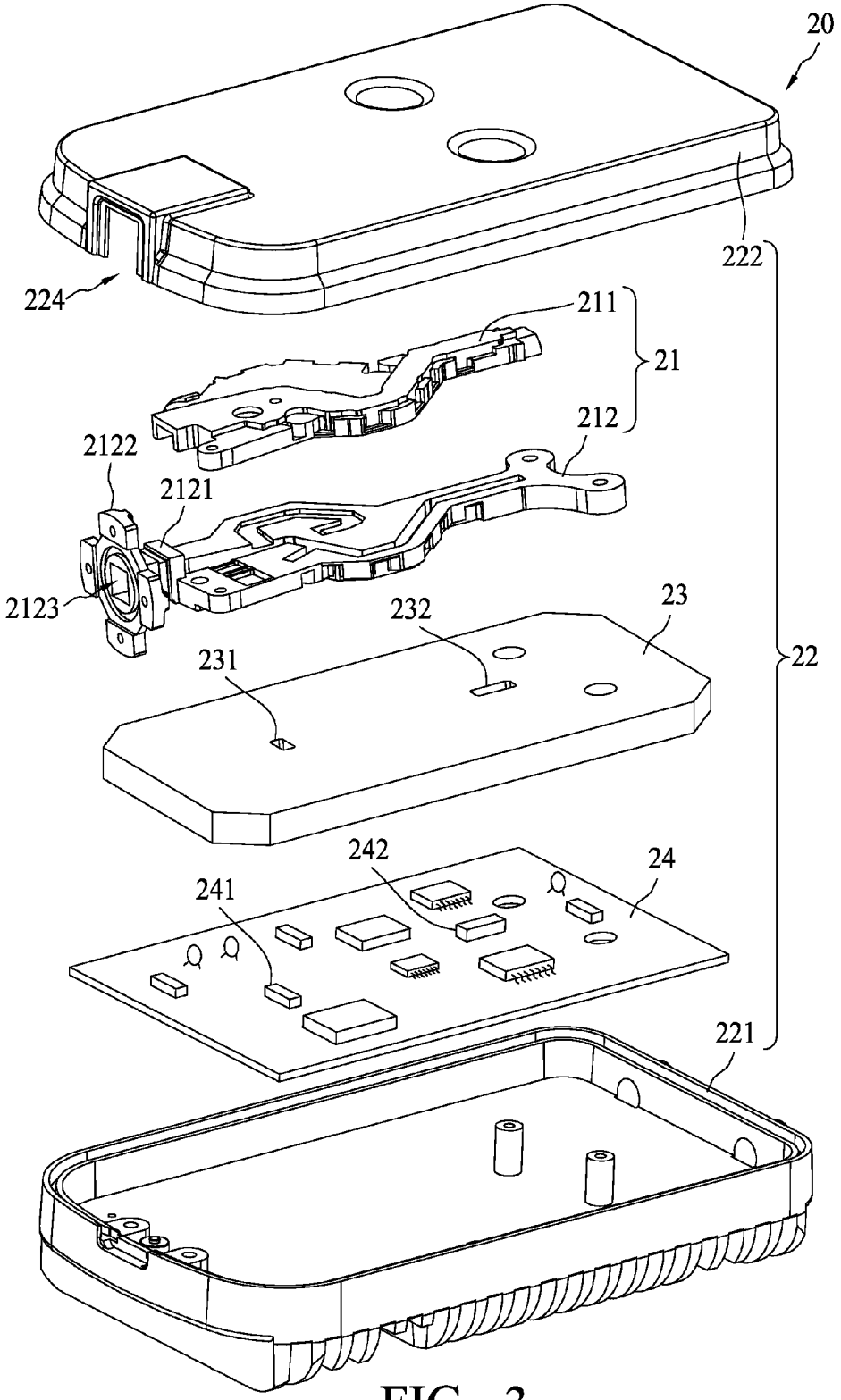
FIG. 3 is an exploded diagram of the integral high frequency communication apparatus of FIG. 2.

FIG. 3 is an exploded diagram of the integral high frequency communication apparatus in FIG. 2. The integral high frequency communication apparatus 20 comprises the case 22, a waveguide apparatus 21 having the extension portion 2121, the spacing module 23 having two waveguide openings, and a circuit board 24. The waveguide apparatus 21, the spacing module 23, and the circuit board 24 are sequentially disposed in the body 221. The spacing module 23 is disposed between the waveguide apparatus 21 and the circuit board 24.

The waveguide apparatus 21 comprises a first separated block 211 and a second separated block 212 which respectively contain a portion of the extension channel 2123. The first separated block 211 and the second separated block 212 form partial waveguide structure. The extension portion 2121 is placed on the front end of the second separated block 212, and includes the extension channel 2123 through therein. The profile of the extension channel 2123 is similar to that of the waveguide channel of the waveguide apparatus 21. The cross-sectional area of the extension channel 2123 and that of the waveguide channel of the waveguide apparatus 21 are the same at the junction of the extension channel 2123 and the waveguide channel. That is, the extension channel 2123 is the extension of the waveguide apparatus 21. The plurality of combination flanges 2122 are provided on the front end of the extension portion 2121, and are used to mount the assembled high frequency communication apparatus 20 on the satellite antenna. The second separated block 212, the extension portion 2121, and the combination flanges 2122 can be integrated into a single part so that no junctions exist.

The circuit board 24 is accommodated in the case 20 and includes a signal transmitting unit 241 and a signal receiving unit 242. The signal transmitting unit 241 generates a high frequency signal, which is transmitted by the waveguide apparatus 21. The signal receiving unit 242 processes a high frequency signal received by the waveguide apparatus 21.

The spacing module 23 is disposed between the waveguide apparatus 21 and the circuit board 24. The spacing module 23 has a first waveguide opening 231 and a second waveguide opening 232 respectively corresponding to a signal transmitting opening and signal receiving opening (not shown in the figures) of the waveguide apparatus 21. By such design, the high frequency signal generated by the signal transmitting unit 241 can be transmitted toward the waveguide apparatus 21 through the first waveguide opening 231. The receiving unit 242 can process the high frequency signal received through the second opening 232. Thus, the first waveguide opening 231 outputs the high frequency signal transmitted by the waveguide apparatus 21, and the second waveguide opening 232 processes the high frequency signal received by the waveguide apparatus 21.

Figure 1:
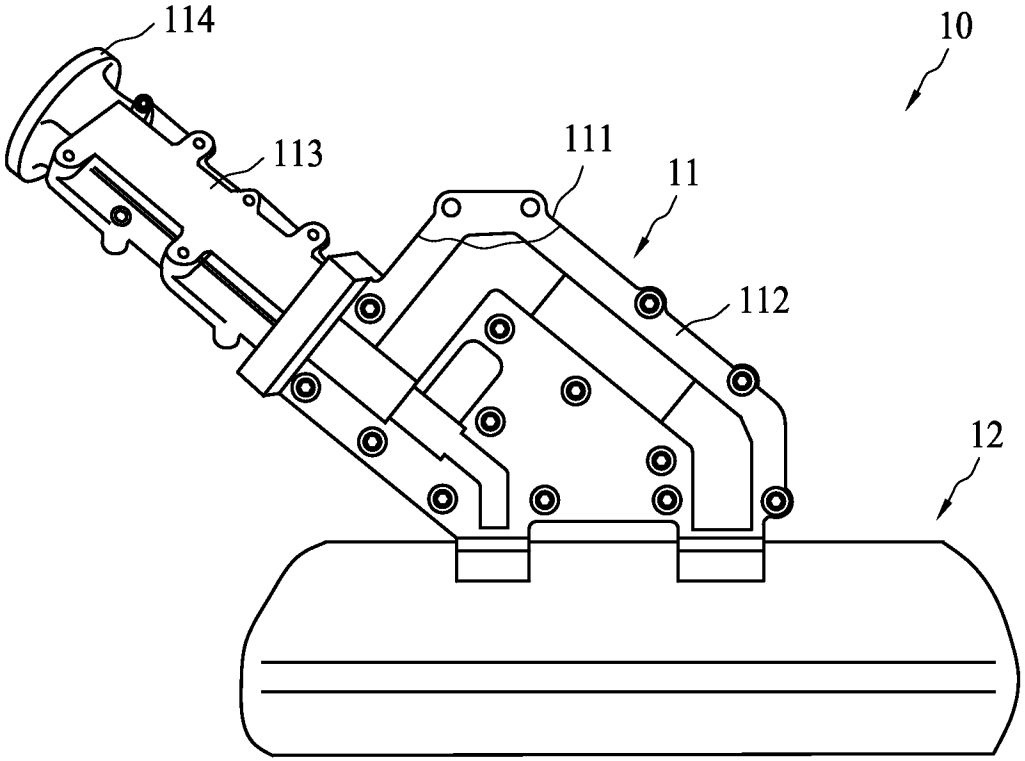
FIG. 1 (Prior Art)
FIG. 1 is a schematic diagram of a traditional high frequency communication apparatus for outdoor use.
Figure 4:
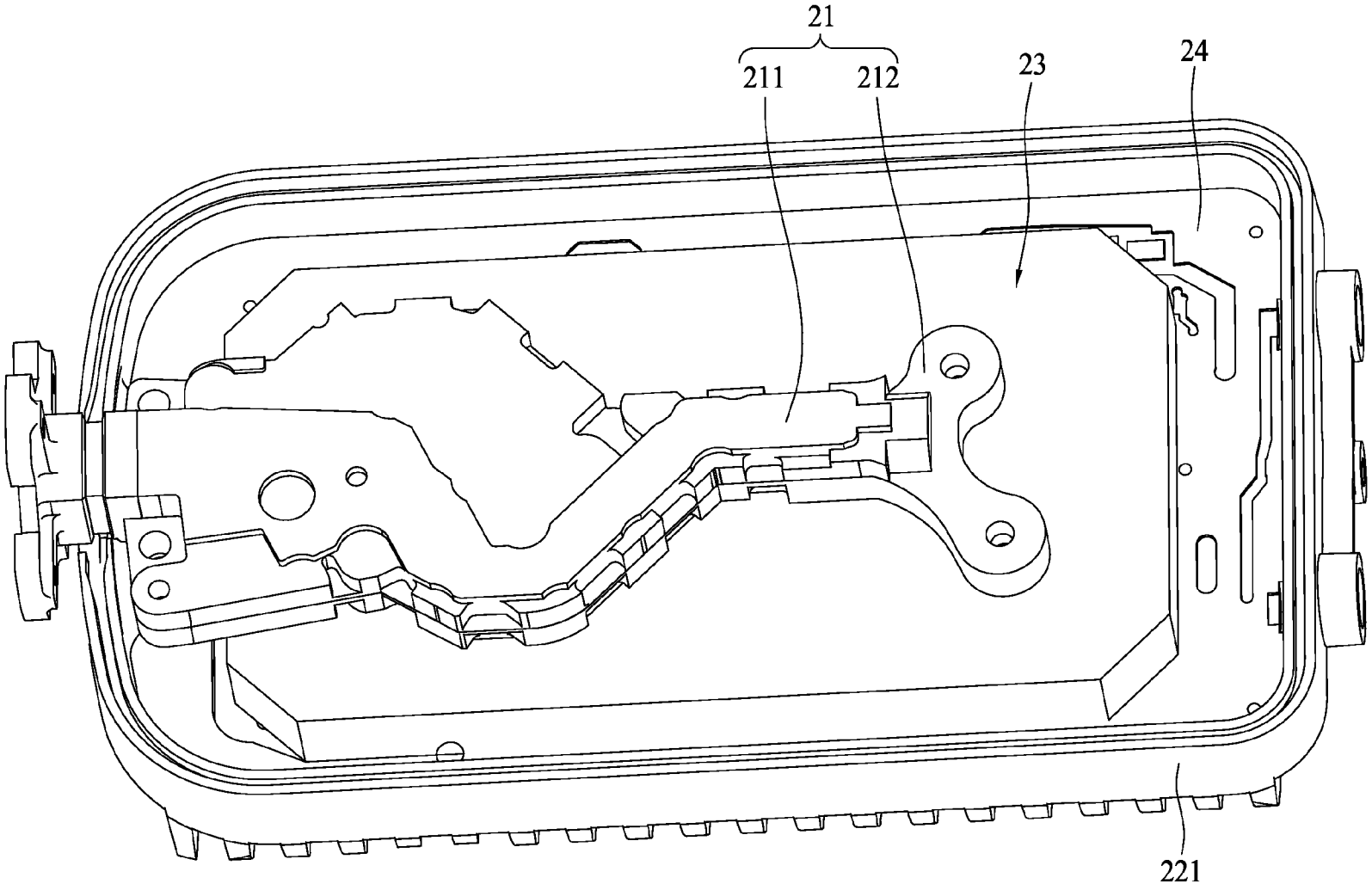
FIG. 4 is a perspective diagram of the integral high frequency communication apparatus without the case in FIG. 2.

FIG. 4 is a perspective diagram of the integral high frequency communication apparatus without the case in FIG. 2. The waveguide apparatus 21, the spacing module 23, and the circuit board 24 are sequentially disposed in the body 221. The spacing module 23 is between the waveguide apparatus 21 and the circuit board 24. The waveguide apparatus 21 is almost completely disposed in the body 221, and the exposed portion of the waveguide apparatus 21 is minimized. Furthermore, the waveguide apparatus 21 and the lowermost plane of the body 221 are close to each other. The transmitting direction of the electromagnetic waves in the waveguide apparatus 21 is approximately parallel to the lowermost plane of the body 221. By contrast, the transmitting direction of the electromagnetic waves in FIG. 1 is perpendicular to the lowermost plane of the body. Consequentially, the volume of the entire communication apparatus can be reduced.

The above-described embodiments of the present invention are intended to be illustrative only. Those skilled in the art may devise numerous alternative embodiments without departing from the scope of the following claims.

What is claimed is:

1. An integral high frequency communication apparatus comprising:

a case comprising an opening;

a waveguide apparatus disposed in the case and comprising an extension portion out of the case through the opening;

a circuit board, accommodated in the case, and including a signal transmitting unit and a signal receiving unit, wherein the signal transmitting unit generates a high frequency output signal transmitted by the waveguide apparatus, and the signal receiving unit processes a high frequency input signal received by the waveguide apparatus; and a spacing module, disposed between the waveguide apparatus and the circuit board, wherein the spacing module has a first waveguide opening and a second waveguide opening and disposed in the case;

wherein the first waveguide opening outputs the high frequency output signal transmitted by the waveguide apparatus, and the second waveguide opening processes the high frequency input signal received by the waveguide apparatus;

wherein the high frequency output signal is transmitted from the signal transmitting unit of the circuit board to the waveguide apparatus via the first waveguide opening of the spacing module, and the high frequency input signal is transmitted from the waveguide apparatus to the signal receiving unit of the circuit board via the second waveguide opening.

2. The integral high frequency communication apparatus of claim 1, wherein the case comprises a body and a cover that are combined with each other.

3. The integral high frequency communication apparatus of claim 1, further comprising a plurality of combination flanges disposed on a side of the extension portion opposite the case and surrounding an extension channel of the extension portion.

4. The integral high frequency communication apparatus of claim 3, further comprising at least a positioning plane disposed on a side of one of the plurality of combination flanges facing the extension channel.

5. The integral high frequency communication apparatus of claim 1, wherein the communication channels of the integral high frequency communication apparatus comprise Ku band, C band or Ka band.

6. The integral high frequency communication apparatus of claim 1, wherein the waveguide apparatus comprises a first separated block and a second separated block.

* * * * *